US006364021B1

(12) United States Patent
Coats

(10) Patent No.: US 6,364,021 B1
(45) Date of Patent: Apr. 2, 2002

(54) WELL MANAGEMENT SYSTEM AND METHOD OF OPERATION

(75) Inventor: E. Alan Coats, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/613,375

(22) Filed: Jul. 11, 2000

(51) Int. Cl.[7] ..... E21B 43/017

(52) U.S. Cl. ..... 166/350; 166/355; 166/366; 166/367; 166/380

(58) Field of Search ..... 166/335, 350–352, 166/355, 359, 366, 367, 380

(56) References Cited

U.S. PATENT DOCUMENTS

| | | | | |
|---|---|---|---|---|
| 4,205,379 A | | 5/1980 | Fox et al. | 364/432 |
| 4,650,431 A | | 3/1987 | Kentosh | 441/5 |
| 5,295,546 A | * | 3/1994 | Giannesini et al. | |
| 5,855,062 A | * | 1/1999 | Kendall | |
| 5,872,406 A | | 2/1999 | Ullman et al. | 290/53 |
| 5,921,285 A | | 7/1999 | Quigley et al. | 138/125 |
| 5,978,739 A | | 11/1999 | Stockton | 702/6 |
| 5,979,881 A | * | 11/1999 | Kendall | |
| 6,004,639 A | | 12/1999 | Quigley et al. | 428/36.3 |

* cited by examiner

*Primary Examiner*—Roger Schoeppel
(74) *Attorney, Agent, or Firm*—Conley, Rose & Tayon, P.C.

(57) ABSTRACT

An offshore field management system which includes a composite riser, a floating buoy and a service vessel. The riser is extended from a subsea well head to the buoy. Conductors, preferably provided in the riser, are connected with a well telemetry system. The buoy has a floating or semi-submersible hull that includes a hatch covering a moonpool for receiving the riser. The buoy preferably includes satellite communication hardware and computer systems in communication with the well telemetry system via riser embedded conductors. The well environment can be remotely monitored using the buoy communication system. Servicing of the oilfield well is accomplished using the service vessel by docking the buoy in a bay formed in the service vessel. The service vessel is preferably a self-contained facility fitted with the equipment and materials necessary to carry out pre-determined well servicing operations. Service vessel personnel deploy the equipment and material into the riser via the buoy hatch after the buoy has been docked in a bay formed in the service vessel.

20 Claims, 6 Drawing Sheets

WELL MANAGEMENT SYSTEM AND METHOD OF OPERATION

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention generally relates to systems and methods for the economical management of hydrocarbon reserves located beneath the ocean floor. More particularly, the present invention relates to a general service vessel adapted to perform all well servicing operations and a floating buoy connected to a composite riser extending to one or more subsea well heads. In a different aspect, the present invention relates to methods for servicing deepwater hydrocarbon fields.

2. Description of the Related Art

Programs for recovering hydrocarbon reserves from beneath the ocean floor are now commonplace. Like their land-based counterparts, an offshore oilfield may have one or more wells extending into a subterranean formation. Additional equipment and facilities, however, are required to conduct offshore well operations because these wells are beneath hundreds or perhaps thousand of feet of water. A typical prior art offshore drilling and production system suitable for recovering subsea hydrocarbon reservoirs in an ocean environment is illustrated in FIG. 1.

Generally, a conventional offshore drilling and production system includes an operations facility 10 at the ocean's surface 12 and production equipment 14 located at the mudline 16 on the ocean floor. In a deepwater field, i.e., where the water is too deep to establish a foundation on the ocean floor for a platform, a floating facility 10, such as a floating rig or semi-submersible vessel, is used to conduct drilling and intervention operations. Equipment at the mudline 16 can include a subsea wellhead system 18 for supporting concentric tubular pipe strings, such as casing and tubing 22, within a subsea wellhead 24 with the casing 20 and tubing extending into the well bore 26. A steel marine riser 28 extends from to the subsea wellhead 24 to the floating platform 10.

In prior art systems, the floating platform 10 is towed to a location generally above a subsea field. Thereafter, the floating platform is used as a base to drill, complete, produce and possibly workover one or more wells. Typically, the floating platform remains at this location for the duration of the productive life of the subsea field. This floating platform continues to be used for later well servicing operations, such as well stimulation, intervention, workover and drilling of lateral bores. Floating platforms are generally massive structures that are designed to withstand decades of service in a harsh ocean environment. Often, these floating platforms must meet rigid safety codes imposed by the controlling governmental authority. Thus, as is well known, it is not uncommon for floating platforms to cost upwards of one billion dollars to construct and bring into service.

Because of the enormous capital cost associated with a floating platform, well owners must be selective in planning and developing deepwater fields. Often, only those fields that have the potential to produce hydrocarbons in sufficient quantity to offset this capital outlay can be targeted for exploitation. This substantial capital outlay not only reduces the number of eligible fields, but also reduces the profitability of each field ultimately selected.

As is also well known, well operators typically optimize the floating platform to perform particular well operations such as drilling and logging efforts associated with the early phases of well construction and completion. After one or more well bores are drilled and completed, the general configuration of the floating platform remains largely unchanged even though later completion, intervention, and workover operations for the wells may be more easily performed by a different configuration.

These prior art well construction and management systems have several drawbacks. For example, because each deepwater field must be individually capable of hydrocarbon production rates sufficient to support at least one dedicated floating platform, many fields, incapable of meeting this threshold profitability requirement, are left undeveloped. Additionally, platforms are usually designed for well construction, a phase taking up only a handful of years in the production life of the well that may last for decades. Thus, for much of the service life of a well, these expensive platforms are less than optimal for well production, workover, intervention and other servicing operations. For example, the lifting and handling equipment and layout of a floating platform may be well suited to drill, case and cement a well bore, but ill suited to carry out frac or stimulation operations or specialized drilling operations.

Another drawback is that well intervention and servicing operations can be performed only after personnel, equipment, and material have been transported to the floating platform. The preparations for initiating these operations often includes contacting a land-based supply center, ordering the needed equipment and materials, having these items packed and shipped to the well site, unpacking these items at the offshore well site, and stowing these items until they are needed. Thus, the logistics for well servicing operations on a distant offshore floating platform are complex and require an additional expense.

The present invention overcomes the deficiencies of the prior art.

BRIEF SUMMARY OF THE INVENTION

The present invention optimizes the configuration of the support structures used in each phase of the hydrocarbon recovery process, including well construction, production, intervention and work over. A exemplary deepwater field may include one or more wells having a wellhead and a well telemetry system that receives electrical signals from sensors and equipment in the well. A preferred embodiment of the present invention features a riser, a floating buoy and a service vessel.

The riser is formed of fatigue-resistant composite material and preferably includes embedded wiring that connects with the well telemetry system. The riser has a first end connected to a wellhead and a second end connected to the buoy. The buoy has a floating or semi-submersible hull that includes a hatch covering a moonpool. The riser passes through the moonpool and connects to the hull generally below the buoy hatch. In the preferred embodiment, the buoy includes telecommunication hardware and computer systems in communication with the well telemetry system via the riser embedded wiring. The service vessel has a bay in which the buoy docks during servicing operations. The service vessel is preferably a self-contained facility having all the personnel, equipment and materials necessary to carry out any number of well servicing operations. Service vessel personnel deploy the equipment and material into the riser via the buoy hatch.

A preferred method of the present invention includes towing a floating drilling rig buoy into a deepwater field to support initial well construction activity. After a well has been drilled and mudline equipment, such as a wellhead and the like, has been installed, the floating drilling rig platform is towed away to support well operations elsewhere. In its place, the floating buoy is stationed at the water's surface generally above the wellhead. The well environment can be remotely monitored using the buoy communication system. When desired, the service vessel is dispatched to the deepwater field to perform one or more servicing operations. The service vessel docks with the buoy and draws the buoy into the bay of the vessel. Thereafter, service personnel deploy the necessary equipment and material into the riser via the buoy hatch. Once servicing operations are complete, the service vessel casts off the buoy and sails to the next buoy or field.

Thus, the present invention presents a number of advantages over the prior art. For example, a deepwater field no longer requires a dedicated floating rig; thus, the floating drilling rig can be utilized for a number of offshore oilfields saving cost. Moreover, because the buoy is mechanically and structurally less complex than the floating rig, expenditures on upkeep and maintenance are minimized. Furthermore, because the buoy is much less expensive than a floating rig, the financial loss of a buoy due to weather or accident is not as severe. Even further, the self-contained service vessel eliminates the need to pack, unpack, ship, and stow equipment and material.

Other objects and advantages will be apparent from the following description and claims.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENT

Figure 1:
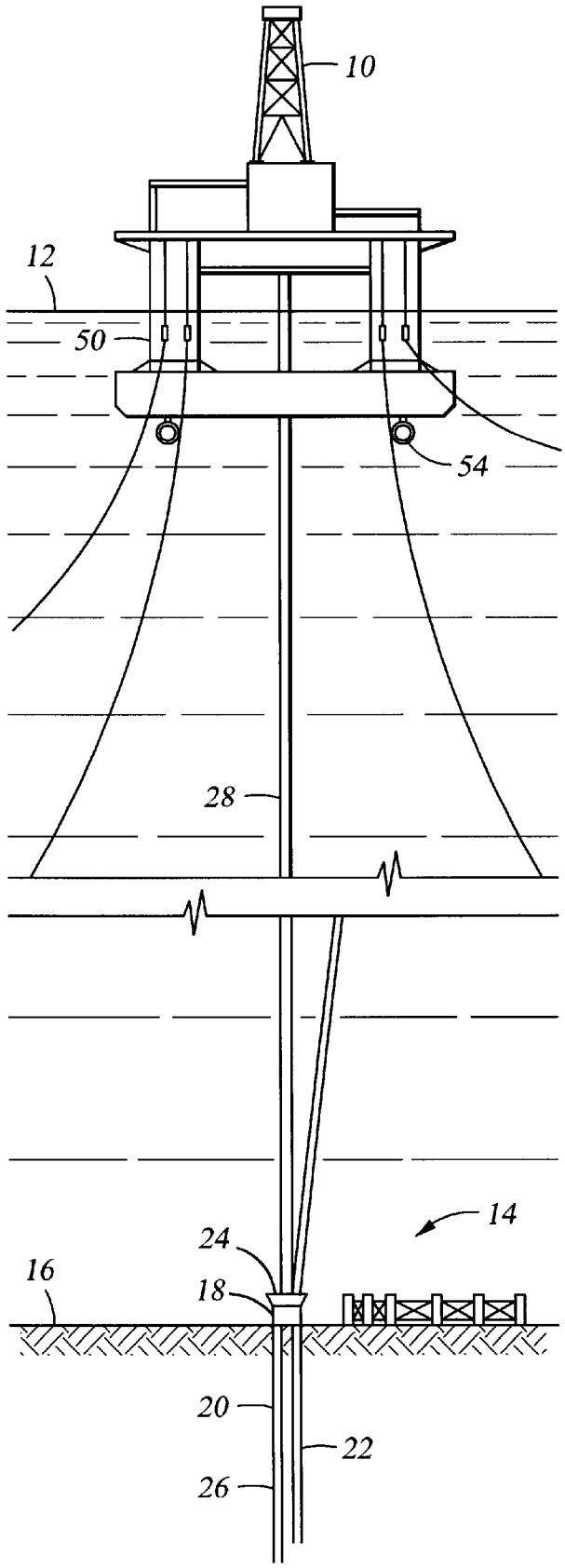
FIG. 1 illustrates a side-view of a prior art offshore platform in a deepwater environment.
Figure 2:
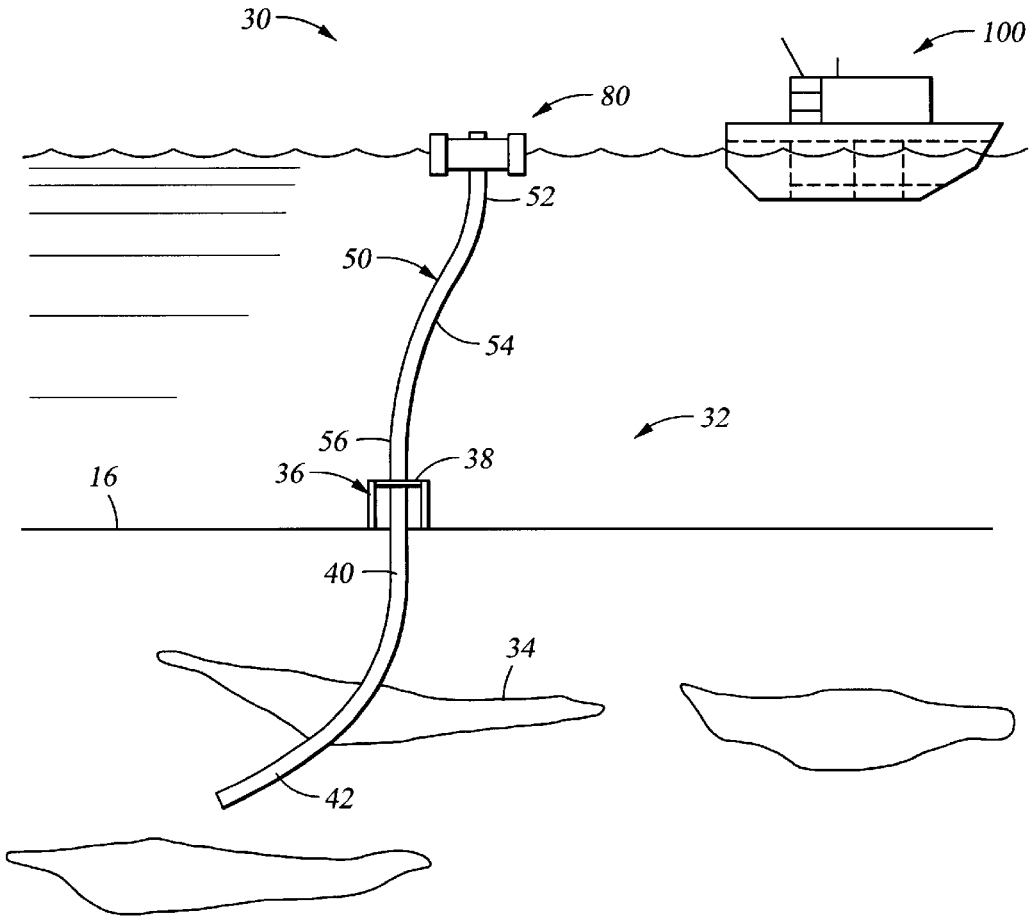
FIG. 2 illustrates side-view of a preferred embodiment of a well management and completion system.

The systems and methods of the present invention enable the efficient and economical management of deepwater oilfields throughout the life of the underlying hydrocarbon reservoirs 34. Referring now to FIG. 2, there is shown a field management and completion system (hereinafter "management system") 30 deployed in a deepwater field 32 for producing hydrocarbons from reservoirs 34 through a well 36 at the mudline 16. Well 36 can include a wellhead 38 that is used to support casing and tubing, collectively referred to 10 with numeral 40, in a wellbore 42. For simplicity, structures such as production trees, underground piping, and subsea storage tanks are not shown as their use and placement would be apparent to one of ordinary skill in the art. A preferred management system implemented in this exemplary environment includes a riser 50, a buoy 80 floating on the ocean surface and a service vessel 100.

Riser 50 provides a conduit for guiding well equipment, such as bottomhole assemblies, and a work string from the water surface to well head 38. Additionally, in instances where a drill or work string (not shown) disposed within riser 50 conveys fluids, such as drilling mud, into wellbore 42, those fluids can return to the surface via the annular space between the inner drill or work string and outer riser 50. Moreover, riser 50 may be used to bring produced formation fluids to the ocean surface. The aforementioned purposes as well as the design of marine risers are well known in the art. Accordingly, the present discussion is directed to advantageous features of riser 50 as utilized in a preferred embodiment of the present invention.

Riser 50 is preferably tubular and includes a surface end 52, a medial span 54 and a subsea end 56. Surface end 52 connects to buoy 80 and subsea end 56 connects to wellhead 38. Both connections are preferably watertight and also include an emergency quick disconnect feature in the event that either of the connections must be severed. Such connections are well known in the art and will not be described in detail.

Riser 50 is also preferably formed mostly of composite material. As can be appreciated, buoy 80 will rise and fall cyclically due to ocean waves (heave seas). Because riser 50 is connected to buoy 80, riser 50 will encounter cyclical tension as buoy 80 rises and falls with the seas. While cyclical tension can quickly lead to fatigue failure in metal, composite materials are largely immune to the stresses imposed by cyclical tension. The use of composite materials for tubulars utilized in hydrocarbon recovery applications is discussed in co-pending U.S. application Ser. No. 09/081,961, titled "Well System," filed on May 20, 1998, which is hereby incorporated by reference for all purposes. It should be understood, however, that other materials providing similar resistance to fatigue failure may also be used. Utilizing fatigue resistant materials, such as composites, extends the service life of riser—as compared to a metal riser—and thereby enables long term planning for well intervention, completion, and construction activities.

Riser 50 may be a single continuous tubular or a series of joint segments of tubulars. A single continuous riser eliminates the need to have watertight connections. Making up riser 50 using a plurality of tubular segments allows these segments to be fabricated in more manageable lengths. However, care must be taken in making up the connections between adjoining segments to prevent sea water incursion into riser 50. These design considerations as well as other factors inherent to design of risers for deepwater applications will be apparent to one of ordinary skill in the art. For example, the inner diameter of riser 50 must be large enough to accommodate the well tools required for the necessary well operations for well 36.

Figure 3A:
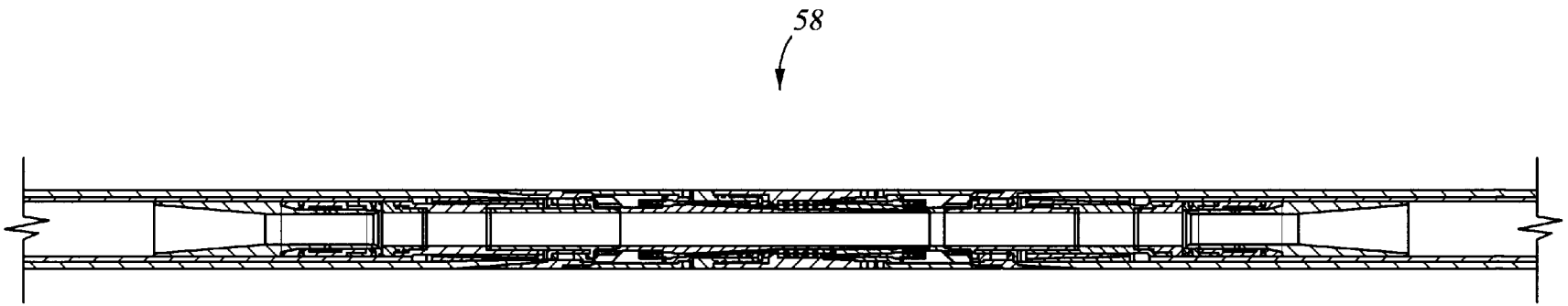
FIG. 3A illustrates a side-view a preferred embodiment of a riser connection.

Referring now to FIG. 3A, there is shown a exemplary connector 58 for making up adjacent composite tubular segments 60 and 62. Generally, a connector body having electrical conductors and terminals is interposed between segments 60 and 62. The details of a connector adapted for use with composite coiled tubing segments are disclosed in U.S. application Ser. No. 09/534,685, filed Mar. 24, 2000, which is hereby incorporated herein by reference. An alternate connection is shown in FIG. 3B wherein adjacent tubular segments 70 and 72 are connected using a well known slip joint 73.

Figure 3C:
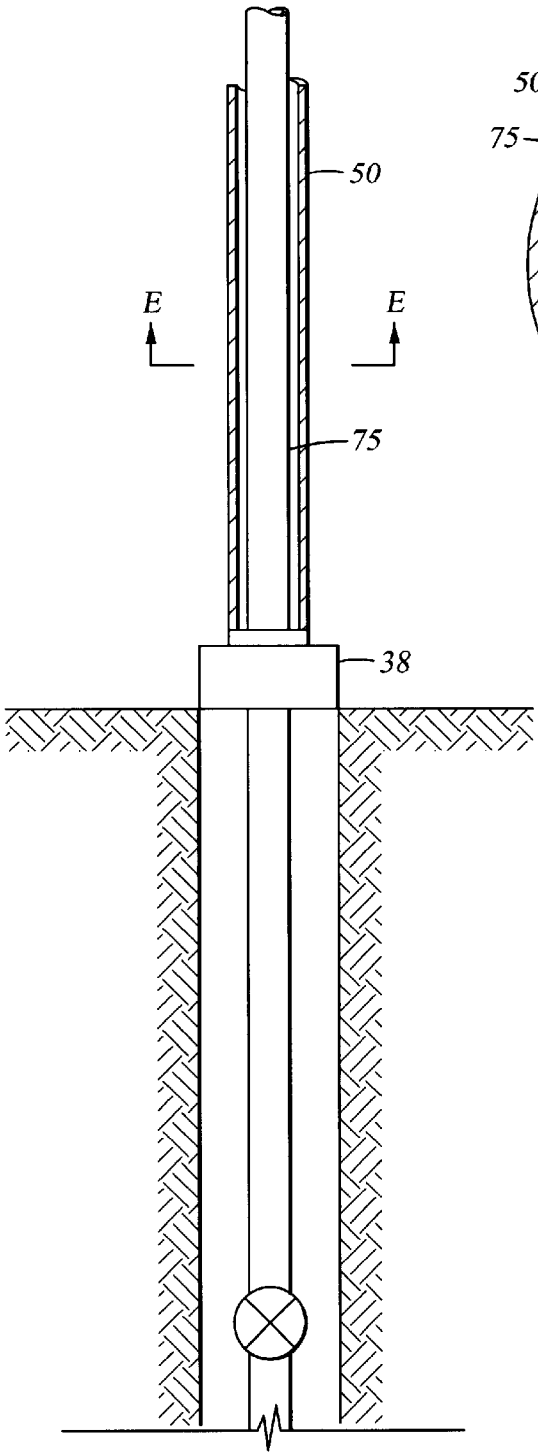
FIG. 3C illustrates a cross-sectional view of a preferred embodiment of a riser and production tubing.
Figure 3D:
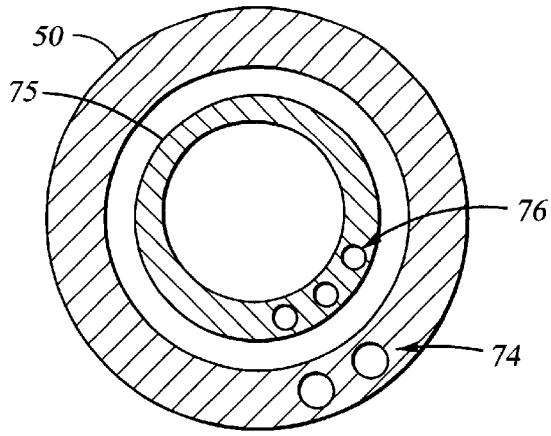
FIG. 3D illustrates a cross-sectional view of a riser and production tubing and their respective embedded wires.
Figure 3B:
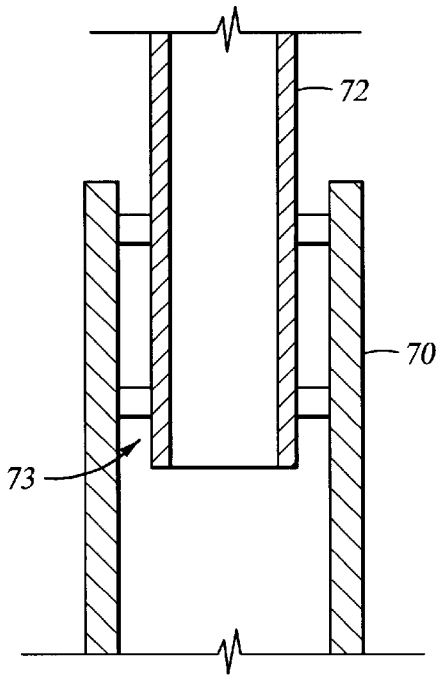
FIG. 3B illustrates a side-view of an exemplary slip joint for a riser connection.

Referring now to FIGS. 3C and 3D, riser 50 may be optionally provided with embedded electrical conductors 74. Similarly, production tubing 75, or other tubing, disposed within riser 50 may also be provided with embedded electrical conductors 76. Composite tubulars with embedded conductors are described in U.S. Pat. Nos. 6,004,639, 5,921,285, and co-pending U.S. application Ser. No. 09/081,961 all hereby incorporated herein by reference in their entirety. As will be described in detail below, these electrical conductors can markedly enhance a well operator's ability to monitor and manage hydrocarbon production activities.

Figure 4A:
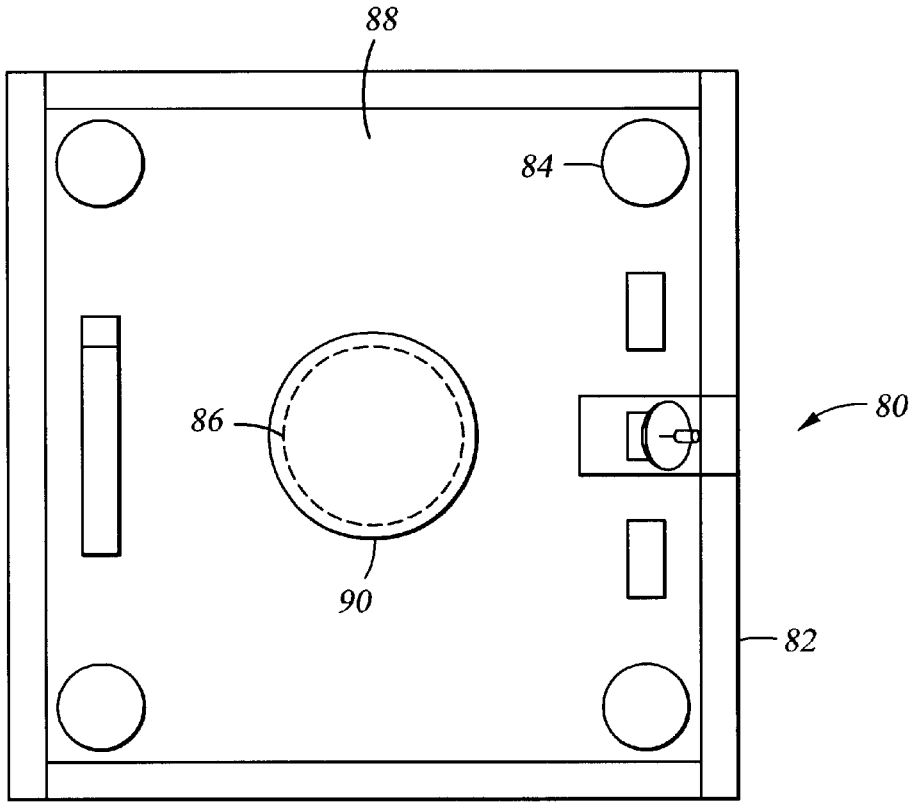
FIG. 4A illustrates a plan view of a preferred embodiment of a buoy.

Referring now to FIGS. 4A and B, buoy 80 is preferably a floating or semisubmersible base for accessing the riser surface end 52 (FIG. 2) of riser 50. Buoy 80 is preferably compact in size and not fitted with provisions or facilities for long term personnel occupation. Nonetheless, as will be apparent, buoy 80 may be as simple or sophisticated as required to efficiently manage a deepwater field. A preferred buoy includes a hull 82 and ballast tanks 84.

Hull 82 is provided with a moonpool 86, a deck 88, and a hatch 90. Deck 88 is preferably a topside reinforced flat surface adapted to safely support well servicing equipment and personnel. Moonpool 86 is an opening in hull 82 that allows access to the water below. Riser surface end 52 (FIG. 2) is received into moonpool 86 and is secured to hull 82 using a flange or collar (not shown). Hatch 90 is disposed generally above moonpool 86 and is formed into deck 88. Hatch 90 includes a removable lid 91 that, when lifted, permits access to moonpool 86 and riser 50. When closed, hatch 90 prevents sea water and other contaminants from entering riser 50 below. While platform 80 is shown with one moonpool for simplicity, it should be understood that two or more moonpools can be utilized. Moreover, buoy 80 may be of any geometric shape, including cylindrical, spherical or rectangular. In accordance with well known methods, hull 82 is formed from high-strength corrosion resistant materials in order to withstand an extended service life in a high seas environment.

Figure 4B:
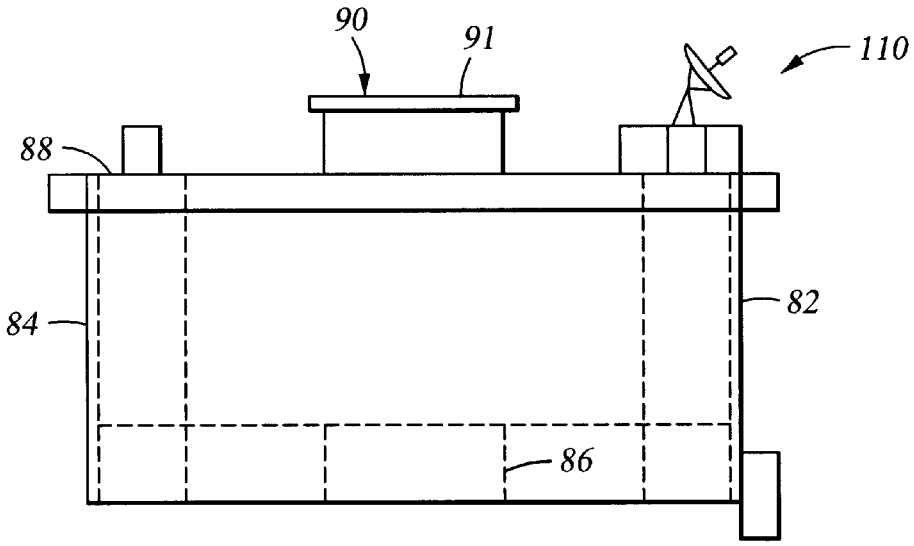
FIG. 4B illustrates a side view of a preferred embodiment of a buoy.

Referring now to FIG. 4B, ballast tanks 84 disposed about the perimeter of hull 82 provide the buoyancy for buoy 80, and thus the draft of buoy 80. Preferably, ballast tanks 84 are air tight compartments that can be selectively filled with fluid such as sea water. As is well known in the art, controlled flooding of ballast tanks 84 will tend to submerge buoy 80 and evacuation of ballast tanks 84 will tend to lift buoy 80. Well known methods and devices such as one-way check valves and high-pressure air may be used to carry out the controlled flooding and evacuation of ballast tanks 84. It should be understood that ballast tanks 84 are merely one means of providing controlled floatation of buoy 80 and that the present invention is not limited to any particular form of ballast tanks. Indeed, it may be that selective buoyancy is not required and that hull 82 itself may be configured to provide the desired draft.

As can be appreciated, buoy 80 is amenable to many design variations that enhance the utility of buoy 80. For example, hatch 90 may be configured to have a generic engagement face that allows for a quick engagement with the equipment on service vessel 100. As will be discussed below, buoy 80 docks with service vessel 100 prior to the initiation of well servicing operations. For some operations, service vessel personnel may simply lift the hatch lid 91 and introduce equipment into the moonpool 86 and riser 50. Other operations may require entering moonpool 86 through a stack that may include snubbers, blowout preventers, an injector, valve assemblies and other such equipment. Thus, hatch 90 is preferably provided with a means for releasably engaging well equipment such as a stack. For example, hatch 90 may include a threaded portion or an annular lip having holes for received fasteners. Alternatively, an annular collar or sliding sleeve (not shown) may be used to lock hatch 90 with well equipment. Moreover, hydraulically actuated locks may be used in lieu of threaded ends or fasteners. It is preferable, however, that the design of hatch 90 be relatively simple in order to minimize the number of parts exposed to the elements, and thus the number of parts susceptible to corrosion and failure.

Buoy 80 may also be optionally fitted with cables (not shown) to anchor buoy 80 to the ocean floor. Alternatively, well known dynamic positioning systems may be used to keep buoy 80 generally stationed over the wellhead 38. Dynamic positioning systems, as well as emergency disconnect features, are discussed in U.S. Pat. Nos. 5,978,739 and 4,205,379, all of which are hereby incorporated by reference.

Buoy 80 may also be optionally provided with electronics such as microprocessors and telecommunication systems. Referring now to FIGS. 2 and 3D, microprocessors (not shown) may be linked to the embedded wiring 74 and 76 of riser 50 and production tubing 75, respectively. Embedded wiring 74 and 76 enable the exchange of electrical signals between the microprocessors and sensors (not shown) and devices along riser 50, at the subsea well head 38 and within the well 36. Exemplary signals include those transmitted by sensors that monitor the integrity of riser 50 and subterranean formation fluid pressure. Exemplary signals also include indications of the position of valves, gates, and also the chemical composition of produced fluids. Microprocessors can collect, process and store the data received. Additionally, the data received may be transmitted by a telecommunication systems, such as a satellite transmitter 110, to a remote station (not shown) for real-time analysis. Electrical power for buoy 80 may be provided by any number of means, such as battery power, or through generators such as those run on tidal motion. Tidal generators are discussed in U.S. Pat. No. 5,872,406, hereby incorporated herein by reference.

Referring again to FIG. 2, service vessel 100 is adapted to carry out well servicing operations using buoy 80. Acid washing, frac operations, sand control, fishing operations, perforations, branch bore drilling operations, formation sampling, well logging are illustrative of the services and operations that may supported by service vessel 100. Accordingly, the service vessel 100 is preferably fitted with general purpose computers, hydraulic pumps, wireline logging equipment, nitrogen tanks, bottomhole assemblies (BHA) and support equipment, storage tanks, cement, drilling mud, frac fluids, reservoir description equipment and other like systems that enable the evaluation and workover of a deepwater well. Also provided in service vessel are living quarters for personnel, communication systems, electrical power generators and other well know utilities and systems that permit service vessel to make extended service campaigns in deepwater fields.

Figure 5A:
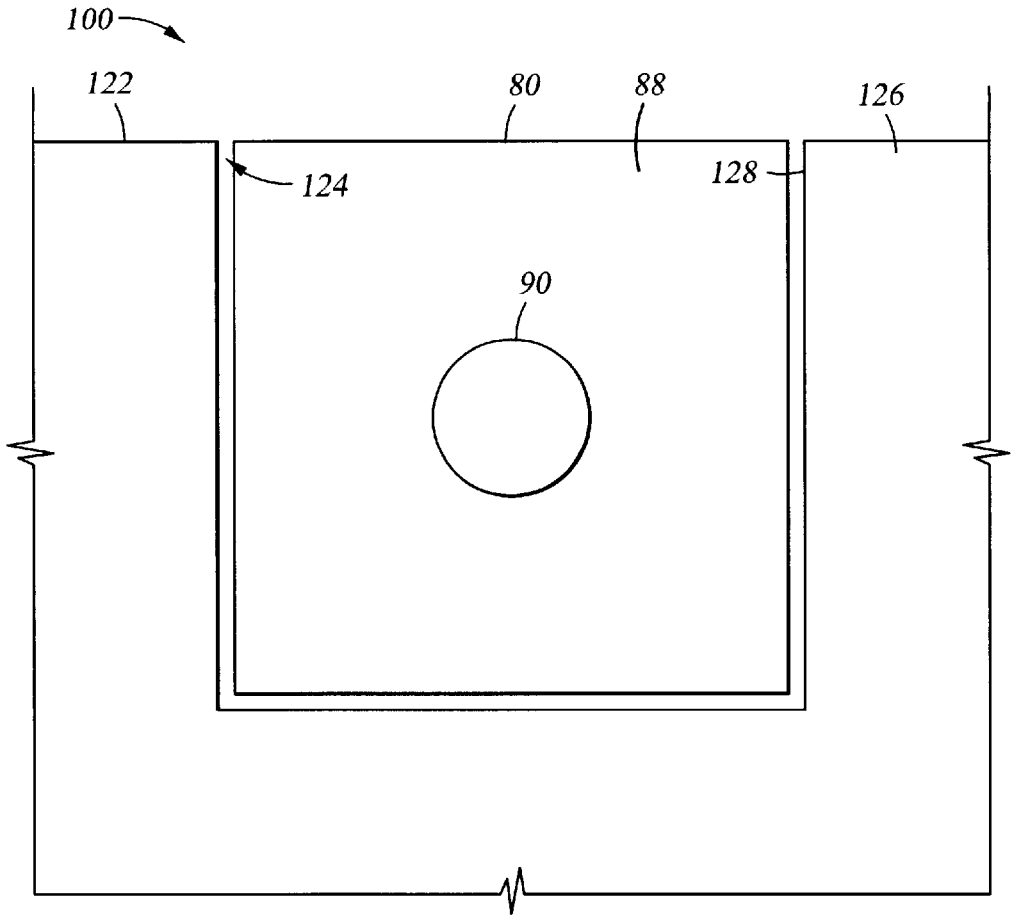
FIG. 5A illustrates a plan view of a buoy, in phantom, moored to a preferred bay in a service vessel.
Figure 5B:
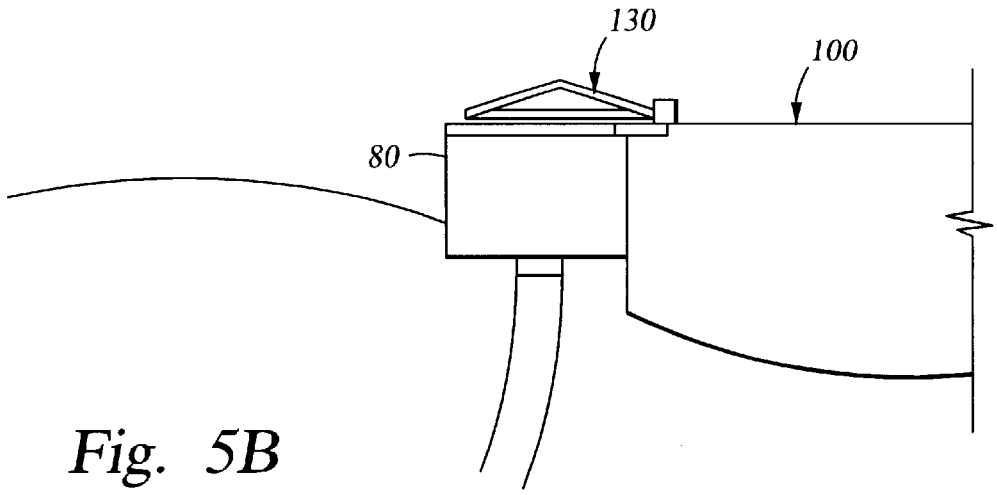
FIG. 5B illustrates a side view of a buoy moored to a service vessel having hydraulic arms engaging the buoy.

Referring now to FIG. 5A, service vessel 100 includes an aft portion 122 provided with a bay 124 for docking with buoy 80 (shown in phantom). Bay 124 includes a rig deck 126 and a recess 128 having a profile that is generally complementary to the shape of buoy 80. It is preferred to effectively integrate buoy 80 into service vessel 100 such that platform deck 88 and rig deck 126 are substantially on the same plane and relative motion between buoy 80 and service vessel 100 is minimized. Mooring buoy 80 with service vessel 100 in this manner enables service vessel personnel to safely and quickly introduce vessel-based equipment into riser 50 (not shown) via the hatch 90 in buoy 80. Referring now to FIG. 5B, alternatively, service vessel 100 may include a pair of hydraulic arms 130 that engage buoy 80 and draw buoy 80 against side of service vessel 100.

The completion system may be deployed, as discussed below, to cost-effectively service deepwater fields. An exemplary use may include a plurality of deepwater subsea wells having been drilled by a floating rig. During this well construction, one or more surface-actuatable flow control devices are installed in the well 36. Such devices are described in U.S. application Ser. No. 09/396,406, titled "Well Management System," hereby incorporated herein by reference. Other devices adapted to transmit electrical signals may also have been provided in well 36 to sense well conditions. Well known telemetry systems may be used to process and relay the electrical signals. After this initial well construction phase, the floating rig is towed to another field and, if noncomposite riser was used, then this riser is replaced with a composite riser 50. The embedded wiring of the composite risers and the embedded wiring of the production tubing (if used) are connected to the well telemetry system.

Thereafter, the composite riser 50 for each well 36 is joined to a buoy 80. Depending on the particular circumstances, one buoy 80 may connect with several composite risers 50 or each riser 50 may have a dedicated buoy 80. A satellite communication system and microprocessors on board buoy are connected to the embedded wiring of riser 50 and production tubing 75 and thereby establish a surface link with the well telemetry system. As well devices feed signals into the well telemetry system, these signals are received by the satellite communication system and relayed to a remote location. Personnel at the remote location can monitor well conditions via the satellite relay. Additionally, personnel can transmit signals that actuate the well devices also via the satellite system. Thus, well personnel are provided with a two-way real time well monitoring system. Moreover, microprocessors on board buoy 80 can either perform preliminary processing of well device signals or may simply store the data for later retrieval. Therefore, while buoy 80 is simply floating or in a semi-submersible state above the deepwater subsea field, it nonetheless can be fitted with instrumentation that enhances its overall utility.

A well operator may decide that production rates for the deepwater field may be improved through intervention or workover. This intervention or workover may include drilling a lateral well from the main well bore 36 in a first zone and a frac operation at a second zone. Service vessel is dispatched to the deepwater field. The service vessel is steered toward the first buoy 80 and is maneuvered such that the bay 124 is oriented toward the buoy 80. Grappling hooks can then be cast and tethered to the buoy 80. Buoy ballast tanks 84 may be either flooded or evacuated in order to generally align buoy deck 88 to service deck 126 of the vessel 100. Once buoy 80 is generally aligned with bay 124, the buoy 80 is drawn in, docked and moored to the vessel 100. To access the riser 50, the hatch lid 91 is removed from the buoy opening and an adapter is secured onto the moonpool 86. For an exemplary drilling operation, a BHA adapted to drill a lateral bore may be run in after equipment such as BOP's and injector have been installed on buoy 80. Similarly, coiled tubing handling equipment may also be used to convey frac equipment downhole. Once all the required operations are done, the equipment is extracted from the well 36 and stowed on the service vessel 100. After the buoy hatch 90 is secured, the buoy 80 is released from the bay 124. Thereafter, the service vessel 100 moves to the next buoy.

While preferred embodiments of this invention have been shown and described, modifications thereof can be made by one skilled in the art without departing from the spirit or teaching of this invention. For example, the embodiments described generally utilize a buoy floating at or near the ocean's surface. However, a buoy may be submerged to a predetermined depth below the ocean surface. Such buoy placement may be preferable in instances where there is a risk that surface vessels may collide with a buoy. Floating and submerged buoys, and connections thereto, are discussed in U.S. Pat. No. 4,650,431, which is hereby incorporated by reference. Accordingly, the embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A system for servicing one or more subsea wells, each having a wellhead, comprising:

a buoy;

a composite riser extending from the wellhead to said buoy; and a service vessel having a bay configured to releasably dock said buoy within said service vessel, said service vessel provisioned to perform at least one well servicing operation via said buoy and said composite riser.

2. The system of claim 1 wherein said riser includes a plurality of lengths connected by one or more connectors.

3. The system of claim 1 wherein said riser includes a wall having at least one wire embedded in said wall, said wire adapted to transmit electrical signals to and from the subsea well.

4. The system of claim 3 further comprising at least one surface-actuatable well device operatively connected to said riser wire.

5. The system of claim 3 further comprising at least one sensor operatively connected to said riser wire.

6. The system of claim 3 wherein said buoy further comprises a telecommunication system, said telecommunication system being connected to said riser wire.

7. The system of claim 3 further comprising tubing axially disposed within said composite riser, wiring provided in said tubing; and wherein said buoy further comprises a telecommunication system, said telecommunication system being connected to said tubing wiring.

8. The system of claim 1 wherein said buoy further comprises an electrical power generation system.

9. The system of claim 1 wherein said buoy flirther comprises a dynamic positioning system.

10. The system of claim 1 wherein said buoy is selectively buoyant.

11. The system of claim 1 further comprising a plurality of composite risers, each of which extends from a wellhead, and wherein said buoy is adapted to receive said plurality of composite risers.

12. The system of claim 1 wherein said service vessel is adapted to perform well stimulation and intervention operations.

13. The system of claim 12 wherein said well operations include drilling operations.

14. A method of managing an offshore hydrocarbon field, comprising:

drilling at least one subsea well;

installing a wellhead on the well;

connecting one end of a composite riser to the wellhead, and connecting the other end of the composite riser to a buoy;

docking the buoy into a service vessel;

performing at least one well servicing operation by accessing the well through the buoy and the riser; and releasing the buoy.

15. The method of claim 14 further comprising providing signal transmissions between a surface actuatable well device and the buoy.

16. The method of claim 14 wherein a plurality of subsea wells are drilled; a wellhead is installed on each subsea well; one end of a riser is connected to each wellhead; the other end of each riser is connected to a buoy; each buoy is successively docked into the service vessel; at least one well servicing operation is performed on each well; and each buoy is successively released.

17. A method of servicing a plurality of subsea wells in a deepwater field, comprising:

connecting the bottom end of a composite riser to each subsea well;

buoying the top end of each composite riser such that the top end floats substantially at the ocean surface;

transporting well equipment to a location proximate to the top end of one riser;

introducing well servicing equipment into the subsea well by entering the top end of the composite riser;

removing at least some of the well servicing equipment from the subsea well via the composite riser;

transporting well equipment to a location proximate to the top end of another riser;

introducing well servicing equipment into the subsea well by entering the top end of the other composite riser; and removing at least some of the well servicing equipment from the subsea well via the composite riser.

18. The method of claim 17 further comprising providing the subsea well with at least one sensor adapted to transmit signals indicating a pre-determined well condition; transmitting the signals via wiring provided in the composite riser to the surface; and monitoring the sensor signals.

19. The method of claim 17 further comprising providing the subsea well with at least one surface-actuatable flow control device; and activating the flow control device.

20. The method of claim 19, wherein the flow control device is activated by a signal transmitted through wiring disposed in the riser.

* * * * *